United States Patent [19]

Butterwick

[11] 4,333,031

[45] Jun. 1, 1982

[54] PHOTOMULTIPLIER TUBE HAVING DIRECTIONAL ALKALI METAL VAPOR EVAPORATION MEANS

[75] Inventor: Gilbert N. Butterwick, Leola, Pa.

[73] Assignee: RCA Corporation, New York, N.Y.

[21] Appl. No.: 240,419

[22] Filed: Mar. 4, 1981

Related U.S. Application Data

[63] Continuation of Ser. No. 25,559, Mar. 30, 1979.

[51] Int. Cl.[3] ..... H01J 40/16; H01J 40/02

[52] U.S. Cl. ..... 313/95; 313/181

[58] Field of Search ..... 313/95, 103 R, 104, 313/105 K, 365, 181, 481, 180

[56] References Cited

U.S. PATENT DOCUMENTS

| | | | |
|---|---|---|---|
| 2,275,864 | 3/1942 | Record | 313/481 |
| 2,676,282 | 3/1954 | Polkosky | 313/95 X |
| 2,829,293 | 4/1958 | Widmaier | 313/95 X |
| 3,372,967 | 3/1968 | Hughes | 316/5 |
| 3,658,400 | 4/1972 | Helvy | 313/94 |
| 3,719,433 | 3/1973 | Rabusin | 313/181 X |
| 3,913,999 | 10/1975 | Clarke | 313/177 |
| 3,945,949 | 3/1976 | Vucht et al. | 313/179 |

FOREIGN PATENT DOCUMENTS

| | | | |
|---|---|---|---|
| 255088 | 4/1960 | Australia | 313/103 |

*Primary Examiner*—Robert Segal

*Attorney, Agent, or Firm*—Eugene M. Whitacre; Dennis H. Irlbeck; Vincent J. Coughlin, Jr.

[57] ABSTRACT

A photoelectric tube, preferably a photomultiplier tube comprises a photoemissive cathode deposited on the inner faceplate of the tube envelope and a dynode assembly mounted within the envelope. The tube includes a generator containing an alkali metal source for deposition of alkali metal onto the cathode surface. The generator has means for directing the alkali metal vapors substantially toward the cathode surface and for preventing the alkali metal vapors from substantially depositing on the dynode assembly.

7 Claims, 4 Drawing Figures

PHOTOMULTIPLIER TUBE HAVING DIRECTIONAL ALKALI METAL VAPOR EVAPORATION MEANS

This is a continuation of application Ser. No. 025,559, filed Mar. 30, 1979.

BACKGROUND OF THE INVENTION

1. Field of the Invention

This invention relates to a photoelectric tube and more particularly to a photomultiplier tube having an improved alkali metal vapor generator for directing the alkali metal vapor substantially toward the photocathode surface.

2. Description of the Prior Art

Many photoelectric tubes such as image intensifier tubes, camera tubes and photomultiplier tubes have photoemissive cathodes or secondary electron emissive surfaces obtained by means of an alkali metal vapor source within the tube envelope. The quantum efficiency and spectral response of these surfaces have been improved by the deposition of multi-alkali metals, such as sodium, potassium and cesium on a substrate of antimony. The known vapor sources utilized to obtain such surfaces typically comprise a metal holder or channel which contains a chromate of the desired alkali metal and a reducing agent for the chromate as described, for example, in U.S. Pat. No. 3,372,967 to Hughes, issued on Mar. 12, 1968. Such channels may be heated to vaporize the alkali metal by well-known direct current or induction heating methods.

In a photomultiplier tube, for example, one or more of the channels are typically mounted near the dynode cage section of the tube, as shown in U.S. Pat. No. 3,658,400 issued to Helvy on Apr. 25, 1972. One problem caused by this construction is that the evaporation of the alkali metal is released uncontrollably from the channels depositing alkali metal vapor on the internal parts as well as on the faceplate surface. Physical restrictions of the vapor deposition due to the geometry of the tube internal components often result in lack of uniformity in cathode thickness, in particular with multiple evaporations. The capability of reproducing cathodes of consistent sensitivities is diminished with the result being undesired spectral variations from tube to tube. This deposition control is further complicated where antimony dynodes are required. The combination of tube geometry and antimony dynodes, having an affinity for the alkali metals, further denies the photocathode surface of receiving an adequate deposit of alkali metal for proper activation.

Another problem concerns the use of the alkali metal vapor sources in tubes to be operated in severe vibrational conditions. These vapor sources must remain in the tube after the evaporating processes, performed after or during tube evacuation, are complete. Severe shock and vibration often shake loose particles of alkali metal from the channels of the known vapor sources. These excess particles can cause undesirable short circuits between components at different potentials. Open circuits can also be caused by erosion of metal contacts due to the abrasiveness of the particles. The overall reliability of the tube under such conditions is thereby reduced.

SUMMARY OF THE INVENTION

A photoelectric tube comprises an evacuated envelope, a photoemissive cathode on the inner faceplate of the envelope and an alkali metal vapor source in the envelope for vapor depositing an alkali metal on the cathode. The tube comprises an improved generator for containing the alkali metal source wherein the generator includes means for directing the alkali metal evaporation substantially toward the cathode surface.

DETAILED DESCRIPTION OF THE PREFERRED EMBODIMENT

Figure 1:
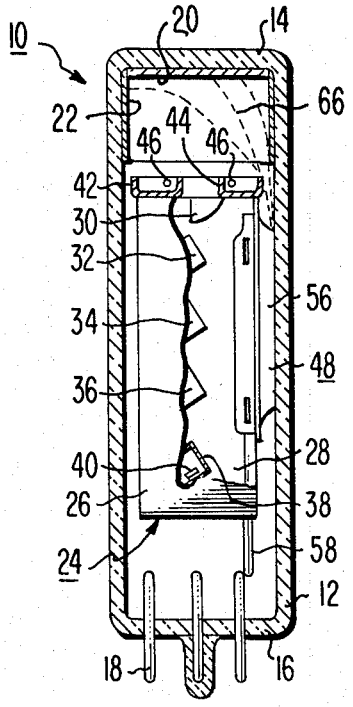
FIG. 1 is a sectional longitudinal view of a photomultiplier tube with internal parts cut away to show more clearly a novel alkali metal vapor generator.
Figure 2:
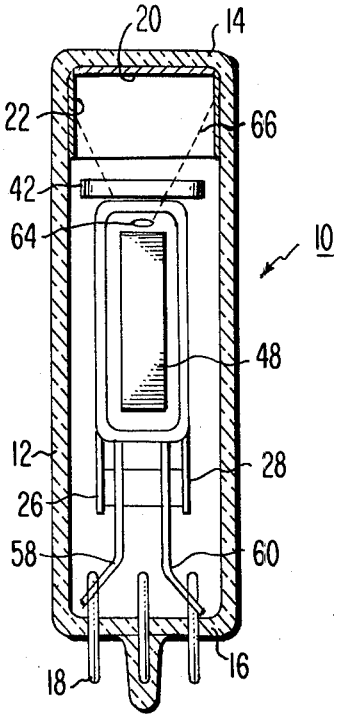
FIG. 2 is a sectional side view of the photomultiplier tube of FIG. 1.

Referring to the drawing, there is shown in FIGS. 1 and 2 a photomultiplier 10, comprising an evacuated envelope 12 of generally cylindrical form having a transparent faceplate 14 and a stem 16 through which a plurality of conductive stem leads 18 are vacuum sealed. A photocathode 20 is formed on the interior surface of the faceplate 14 and an aluminum coating 22 may be deposited on the upper inner surface of the envelope 12, the coating 22 making electrical contact with the photocathode 20.

A dynode assembly, indicated generally as 24, is supported within the envelope 12 preferably by a pair of substantially planar ceramic spacers 26 and 28, although other non-conductive dynode supporting structures may be used. The dynode assembly 24 comprises a plurality of serially aligned dynodes 30–38, preferably of the so-called "box" type, which are partly shown in FIG. 1. Each of these dynodes 30–38 have a secondary electron emissive surface and are preferably formed of copper berrylium, although other materials such as silver magnesium or nickel coated with antimony may also be used. Within the last dynode 38 in the electron path is an anode 40 to collect the secondarily emitted electrons.

A shield 42 having an aperture 44 is placed intermediate the photocathode 20 and the dynode assembly 24 and maintained at a positive potential to enhance the collection and focusing of the photoelectrons emitted by the photocathode 20 in response to incident light. One or more pellets 46 of antimony alloy are suitably disposed around the shield 46 near the faceplate 14 for evaporating antimony. Sources of alkali metals such as cesium, potassium and sodium for evaporation onto the faceplate 14 are included within the envelope 12 in a novel alkali metal vapor generator 48. After the envelope 12 is suitably evacuated, the antimony alloy pellets are heated to vaporize antimony onto the faceplate 14 to a desired thickness or light transmission level. This antimony film is then reacted with vapors of one or more of the alkali metals contained in the generator 48 to sensitize the antimony and form a desired photocathode. In accordance with an improved arrangement for depositing these alkali metal vapors, as will be explained in detail, the generator 48 provides means for directing the alkali vapor evaporation substantially toward the faceplate 14 with little or no alkali vapors being deposited onto the dynode assembly 24.

Figure 4:
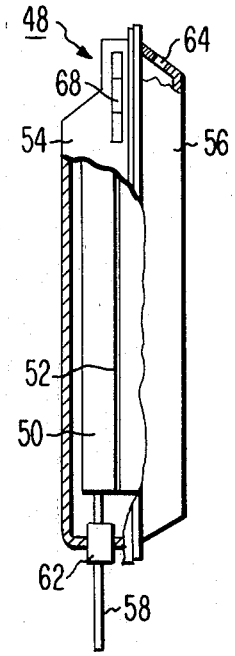
FIG. 4 is a side view of the generator of FIG. 3, partly broken away to show an alkali metal source contained within the generator.
Figure 3:
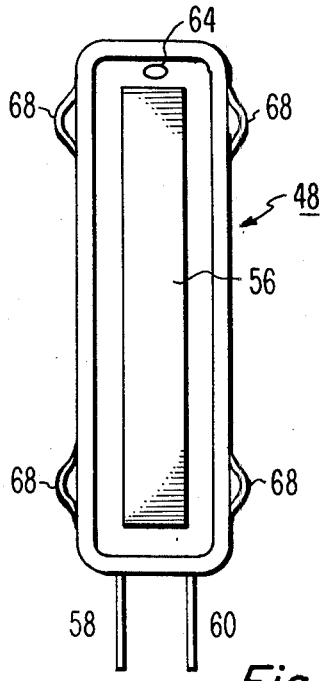
FIG. 3 is an enlarged plan view of the alkali generator shown in FIG. 2.

As shown in detail in FIGS. 3 and 4, the generator 48 is constructed to contain a source of alkali metal such as a conventional tantalum channel 50 comprising a suitable mixture of an alkali metal powder and a reducing agent, the channel 50 having an opening 52 or other means to release a vapor of the alkali metal upon heating. Although the generator 48 is shown containing one channel 50, it should be understood that the generator 48 may be formed to hold a number of channels as sources of alkali metal. In the preferred embodiment, the generator 48 is substantially box-shaped comprising an open-faced receptacle 54 for supporting the channel 50 and a lid 56 to cover the open face of the receptacle 54 and thereby enclose the channel 50. Both the receptacle 54 and the lid 56 are formed preferably of stainless steel although other materials may also be used. Electrical connections for heating the channel 50 are made as by conductive leads 58 and 60 which are attached to the channel 50 and extend from the generator 48 through insulative feedthroughs 62. A current may be applied to the channel 50 through the leads 58 and 60 from a current source (not shown) to resistively heat the channel 50 for evaporating the alkali metal therein. An aperture 64, preferably formed in the lid 56, is provided in the generator 48 to direct the vapors released from the channel 50 in a particular direction in the envelope 12, i.e., toward the photocathode surface and to prevent alkali vapors from undesirably depositing on other areas or components in the tube 10.

Referring back to FIGS. 1 and 2, the generator 48 is mounted at the upper section of the dynode assembly 24 so that the lid 56 is in a space between the dynode assembly 24 and the inner wall of the envelope 12 with the aperture 64 disposed proximate the photocathode surface and the lid 56 preferably bearing against the inner wall of the envelope 12. Generator leads 58 and 60 are connected to respective stem leads 18 which are in turn connected to a direct current source (not shown) for supplying current to heat the generator 50. In a preferred embodiment, the lid 56 is so formed that when the generator 48 is mounted in place, the wall having the aperture 64 is at an angle with respect to the faceplate 14 so that the aperture 64 partially faces the inner wall of the envelope 12. Upon heating the channel 50 to a temperature at which the alkali metal vaporizes in a vacuum, the vapors so generated emanate from the aperture 64 and are directed away from the dynode assembly 24 and toward the faceplate 14 with portions of the released vapor being reflected from the upper inner wall of the envelope 12 to the faceplate 14 as shown by the vapor stream 66. The generator 48, enclosing the channel 50, prevents the uncontrolled evaporation of alkali metals onto other areas of the tube, especially the dynode assembly 24.

In addition to providing directional evaporation of alkali metals to the photocathode surface, the generator 48 also serves as a particle trap for any alakli metal particles that may break loose during operation in environments of severe shock and vibration. Furthermore, the generator 48 may be mounted into the dynode assembly 24 to increase the rigidity of the assembly 24 for withstanding these severe environmental conditions. The generator 48 may include a plurality of spring clips 68 that are used to spring load the generator 48 between the ceramic spacers 26 and 28. The spring clips 68 provide a firm attachment of the generator 48 to the dynode assembly 24 increasing thereby the structural support of the assembly 24 while also providing a means for absorbing thermal stresses induced by differentials in operating temperatures.

The generator 48 may also be utilized in the tube 10 as an electrostatic shield. By providing at the generator 48 a potential that is negative with respect to the dynodes 30–38 a field is established that retards the escape of electrons from the dynode assembly 24. A separate shield typically used in photomultiplier tubes for this purpose may be eliminated.

Although the generator 48 has been hereindescribed in the preferred form of a box, it should be understood that depending upon the tube geometry and shape of the alkali metal sources or channels employed, other generator configurations may also be utilized, with one or more apertures to direct the alkali vapor depositions.

It should also be appreciated that even though the novel alkali containing and directing means has been described in the preferred embodiment of a photomultiplier tube, such means may also be used in other photoelectric devices such as, for example, image intensifier tubes and camera tubes in which photosensitized surfaces are formed by deposition of alkali metal vapors.

What is claimed is:

1. In a photomultiplier tube of the type comprising: an evacuated envelope, said envelope having a faceplate portion with an inner and an outer surface, a photoemissive cathode deposited on the inner surface of the faceplate portion of said envelope, a dynode assembly including a plurality of dynodes arranged to emit secondary electrons in response to electrons emitted from said cathode and an anode for collecting said secondarily emitted electrons, and an alkali metal vapor source for vapor depositing an alkali metal on said inner surface of said faceplate thereby forming said cathode, wherein the improvement comprises:

a generator enclosing said alkali metal vapor source, said vapor source consisting of a resistively heated metal holder including therein an alkali metal powder, said generator including means for trapping particles of said alkali metal powder and means for directing the alkali metal evaporation substantially toward said inner surface of said faceplate thereby preventing the uncontrolled evaporation of alkali metal onto said dynode assembly.

2. A photomultiplier tube according to claim 1 wherein said directing means comprises a portion of said generator having an aperture substantially facing said cathode, said generator being so arranged in said tube that said aperture is proximate said cathode surface.

3. A photomultiplier tube according to claim 2, wherein said generator comprises an open-faced box-like receptacle for supporting said alkali metal vapor source and a lid covering the open face of said receptacle to enclose said source.

4. A photomultiplier tube according to claim 2, wherein said generator is mounted at the upper section of said dynode assembly at a space between said dynode assembly and said envelope, and wherein said aperture is formed in a wall of said lid, said wall having said aperture being disposed at an angle so that said aperture partially faces the inner wall of said envelope such that alkali metal vapors emanating from said aperture are directed away from said dynode assembly, a portion of said vapors being reflected from the wall of said envelope to said cathode surface.

5. A photomultiplier tube according to claim 2, wherein said generator comprises means firmly attaching said generator to said dynode assembly to provide additional rigidity to said dynode assembly.

6. A photomultiplier tube according to claim 2, wherein said generator comprises means insulatively attached to said generator and conductively connected to said metal holder for supplying a current to said metal holder for heating said alkali metal powder.

7. In a photomultiplier tube of the type comprising:

an evacuated envelope, said envelope having a faceplate portion with an inner and an outer surface, a photoemissive cathode disposed on the inner surface of the faceplate portion of said envelope, a dynode assembly including a plurality of dynodes arranged to emit secondary electrons in response to electrons emitted from said cathode and an anode for collecting said secondarily emitted electrons, and a resistively heated metal holder containing an alkali metal powder for vapor depositing an alkali metal on said inner surface of said faceplate thereby forming said cathode, wherein the improvement comprises:

a box-shaped generator including;

an open-faced receptacle for supporting said resistively heated metal holder containing said alkali metal powder, means for making electrical connections to said resistively heated metal holder, and a lid covering the open face of said receptacle, said lid having an aperture therethrough, said aperture being disposed so that the alkali metal evaporation from said metal holder enclosed within said generator is directed substantially toward said inner surface of said faceplate thereby preventing the uncontrolled evaporation of alkali metal onto said dynode assembly, said generator providing a particle trap for the alkali metal powder that may be evolved from the resistively heated metal holder.

* * * * *